US011395948B2

(12) United States Patent
Hawkins, III et al.

(10) Patent No.: US 11,395,948 B2
(45) Date of Patent: Jul. 26, 2022

(54) BICYCLE CLIMBING AND DESCENDING TRAINING DEVICE

(71) Applicant: Wahoo Fitness LLC, Atlanta, GA (US)

(72) Inventors: Harold M. Hawkins, III, Atlanta, GA (US); Jose R. Mendez, Columbus, OH (US); Shane A. Byler, Mableton, GA (US); Michael J. Carlson, Atlanta, GA (US); Megan K. Powers, Marietta, GA (US)

(73) Assignee: Wahoo Fitness, LLC, Atlanta, GA (US)

( * ) Notice: Subject to any disclaimer, the term of this patent is extended or adjusted under 35 U.S.C. 154(b) by 0 days.

(21) Appl. No.: 16/915,898

(22) Filed: Jun. 29, 2020

(65) Prior Publication Data

US 2021/0023431 A1 Jan. 28, 2021

Related U.S. Application Data

(63) Continuation of application No. 16/036,626, filed on Jul. 16, 2018, now Pat. No. 10,695,638.

(Continued)

(51) Int. Cl.

*A63B 69/16* (2006.01)
*A63B 24/00* (2006.01)

(Continued)

(52) U.S. Cl.

CPC ..... *A63B 69/16* (2013.01); *A63B 22/0023* (2013.01); *A63B 24/0062* (2013.01); *A63B 24/0075* (2013.01); *A63B 24/0084* (2013.01); *A63B 24/0087* (2013.01); *A63B 71/0619* (2013.01); *A63B 2024/0093* (2013.01); *A63B 2069/162* (2013.01); *A63B 2071/0655* (2013.01); *A63B 2220/12* (2013.01);

(Continued)

(58) Field of Classification Search

CPC ..... A63B 22/0023; A63B 23/0062; A63B 23/0087; A63B 23/0084; A63B 23/0075; A63B 69/16; A63B 71/0619; A63B 2024/0093; A63B 69/162; A63B 2071/0655; A63B 2201/12; A63B 2201/50; A63B 2201/09; A63B 2201/801; A63B 2201/80; A63B 2201/40; A63B 2201/18

See application file for complete search history.

(56) References Cited

U.S. PATENT DOCUMENTS 4,976,424 A * 12/1990 Sargeant ..... A63B 21/0053 482/3
6,712,737 B1 * 3/2004 Nusbaum ..... A63B 69/16 482/57

(Continued)

FOREIGN PATENT DOCUMENTS

EP 0995466 A1 * 4/2000 ..... A63B 69/16

*Primary Examiner* — Megan Anderson
(74) *Attorney, Agent, or Firm* — Polsinelli PC

(57) ABSTRACT

A training device for use with a bicycle includes a shuttle guide member including a lower end and an upper end that define an axis therebetween. A shuttle is operably coupleable to a front end of the bicycle and translatable along the axis by a drive coupled to the shuttle. When coupled to the front end of the bicycle, translation of the shuttle along the axis by the drive results in each of a rotation of the shuttle guide member about a pivot and a change in elevation of the front end of the bicycle.

20 Claims, 9 Drawing Sheets

Related U.S. Application Data

(60) Provisional application No. 62/534,296, filed on Jul. 19, 2017.

(51) Int. Cl.
*A63B 22/00* (2006.01)
*A63B 71/06* (2006.01)

(52) U.S. Cl.
CPC ..... *A63B 2220/18* (2013.01); *A63B 2220/40* (2013.01); *A63B 2220/80* (2013.01); *A63B 2220/801* (2013.01); *A63B 2225/09* (2013.01); *A63B 2225/20* (2013.01); *A63B 2225/50* (2013.01)

(56) References Cited

U.S. PATENT DOCUMENTS

| | | | | |
|---|---|---|---|---|
| 8,444,147 | B2 * | 5/2013 | Grauzer | A63F 1/12 273/149 R |
| 2007/0004565 | A1 * | 1/2007 | Gebhardt | A63B 69/16 482/61 |
| 2011/0039664 | A1 * | 2/2011 | Cooper | A63B 69/16 482/61 |
| 2019/0134480 | A1 * | 5/2019 | Liao | A63B 21/225 |

* cited by examiner

BICYCLE CLIMBING AND DESCENDING TRAINING DEVICE

CROSS-REFERENCE TO RELATED APPLICATION

This application is a continuation of U.S. patent application Ser. No. 16/036,626, filed Jul. 16, 2018, titled "Bicycle Climbing and Descending Training Device," now U.S. Pat. No. 10,695,638, which is related to and claims priority under 35 U.S.C. § 119(e) from U.S. patent application Ser. No. 62/534,296, filed Jul. 19, 2017, titled "BICYCLE CLIMBING AND DESCENDING TRAINING DEVICE," the entire contents of which are incorporated herein by reference for all purposes.

TECHNICAL FIELD

Aspects of the present invention involve a cycling training apparatus, and, in particular, a climbing trainer for dynamically adjusting inclination of a bicycle connected to the trainer.

BACKGROUND

Busy schedules, bad weather, focused training, and other factors cause bicycle riders ranging from the novice to the professional to train indoors. Numerous indoor training options exist including exercise bicycles and trainers. An exercise bicycle looks similar to a bicycle but without actual wheels, and includes a seat, handlebars, pedals, crank arms, a drive sprocket and chain. An indoor trainer, in contrast, is a mechanism that allows the rider to mount her actual bicycle to the trainer, with or without the rear wheel, and then ride the bike indoors. The trainer provides the resistance and supports the bike but otherwise is a simpler mechanism than a complete exercise bicycle. Such trainers allow a user to train using her own bicycle, are much smaller than full exercise bicycles, and are often less expensive than full exercise bicycles.

While very useful, conventional exercise bicycles and trainers can suffer from limitations that prevent a rider from accurately simulating a road or trail ride and, in particular, hills or other changes in elevation that a rider may encounter during a real-world ride. More specifically, some conventional trainers allow a user to modify a resistance provided by the trainer. Although resistance changes may be used to approximate the effort required for overcoming certain terrain, many conventional trainers do not change the orientation of the bicycle to simulate gradients corresponding to the terrain. As a result, a rider is not generally placed into the same position as would be encountered when actually riding the terrain.

With these thoughts in mind among others, aspects of the training device disclosed herein were conceived.

SUMMARY

In one aspect of the present disclosure a training device for use with a bicycle is provided. The training device includes a shuttle guide member including a lower end and an upper end that define an axis therebetween. A shuttle is operably coupleable to a front end of the bicycle and translatable parallel to the axis by a drive coupled to the shuttle. When coupled to the front end of the bicycle, translation of the shuttle parallel to the axis by the drive results in each of a rotation of the shuttle guide member about a pivot and a change in elevation of the front end of the bicycle.

In another aspect of the present disclosure, a climbing trainer is provided. The climbing trainer includes a housing having a base and an upper end, the base and the upper end defining an axis therebetween. The climbing trainer further includes a shuttle disposed within the housing. The shuttle includes an axle assembly to which a front wheel mount of a bicycle may be connected to operably connect the bicycle to the climbing trainer. The climbing trainer also includes a drive coupled to the shuttle and adapted to move the shuttle along the axis between a lower shuttle position and an upper shuttle position. A curved foot is coupled to the base of the housing, such that the curved foot permits tilting of the exercise apparatus in response to movement of the shuttle when a bicycle is operably connected to the axle assembly.

BRIEF DESCRIPTION OF THE DRAWINGS

Example embodiments are illustrated in referenced figures of the drawings. It is intended that the embodiments and figures disclosed herein are to be considered illustrative rather than limiting.

DETAILED DESCRIPTION

Figure 1A:
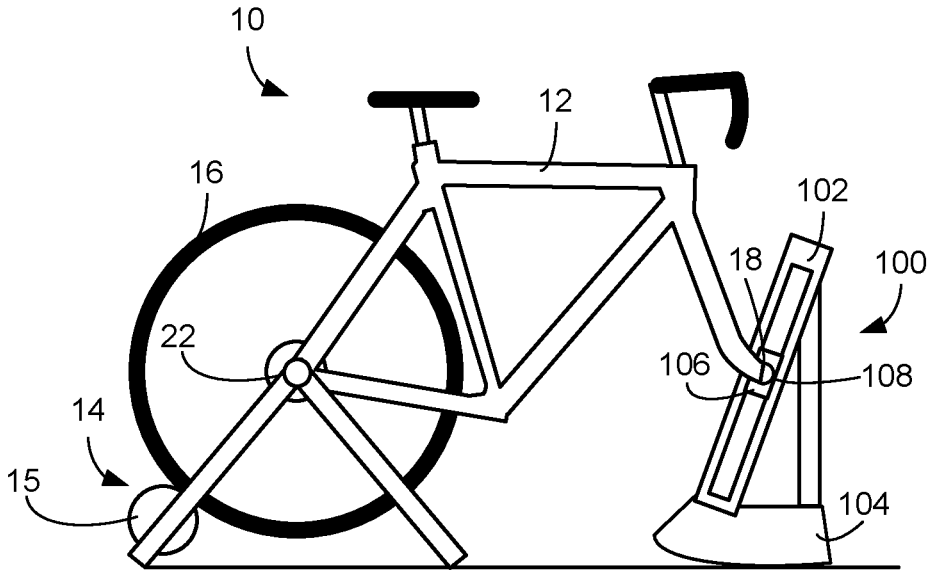
FIGS. 1A and 1B are schematic illustrations of a bicycle training system including a first climbing trainer according to the present disclosure.

Aspects of the present disclosure involve a bicycle climbing and descending training device (referred to herein simply as a "climbing trainer") that may be used to dynamically adjust the elevation of a front end of a bicycle and, as a result, the inclination of the bicycle during the course of a training session. The climbing trainer is generally intended to be used in conjunction with an indoor bicycle trainer to which a rider may mount the rear end of his or her bicycle or cycling rollers on which the rider rests the rear wheel of his or her bicycle. In one example, the climbing trainer may be used in conjunction with a wheel-on style trainer or cycling rollers where the rear wheel of the bicycle is not removed and, when the user pedals, the rear wheel drives a roller or other resistance device. In another example, the climbing trainer may be used with a wheel-off style trainer where the rear wheel of the bicycle is removed and when the user pedals, the chain of the bicycle is connected to a sprocket of the trainer that turns a flywheel or other mechanism.

Climbing training devices in accordance with this disclosure generally include a housing containing a shuttle coupled to a drive such that the shuttle is linearly translatable within the housing along a primarily axis extending in a predominantly vertical direction. The shuttle includes an axle or similar feature to which front drop-outs, through-axle supports, or similar wheel mounts of a front fork of a bicycle may be coupled such that movement of the shuttle causes a corresponding change in the elevation of a front end of the bicycle. In one example, a user removes her front wheel, and mounts the wheel mount of the front forks (where the wheel and axle would normally be mounted), to the axle of the shuttle. Raising or lower the shuttle thus raises or lowers, respectively, the front of the bicycle to simulate climbing or descending. Changing the position of the shuttle along the axis causes the bicycle to rotate about a rear axle such that the front end of the bicycle moves along an arcuate path in a vertical plane. When used in conjunction with an indoor trainer to which the rider directly mounts the rear bicycle, for example, the rear axle generally corresponds to an axle of the trainer. In applications in which the rear wheel of the bicycle is retained on the bicycle, the rear axle corresponds to the axle of the rear wheel.

Climbing trainers in accordance with this disclosure further include a curved base that permits the climbing trainer to rock or tilt in response to changes in the orientation of the bicycle as the front of the bicycle is raised or lowered by the climbing trainer. As previously noted, because the rear axle of the bicycle is generally maintained in a fixed location, the front end of the bicycle, and more particularly the front drop outs, through axle, or other front wheel mount of the front end that is coupled to the climbing trainer, follow an arcuate path as movement of the shuttle changes the elevation of the front end of the bicycle. The arcuate path has a vertical component but also has a horizontal component due to the fixed location of the front wheel mount relative to the rear axle. In other words, as the front wheel mount is raised or lowered, the climbing trainer needs to accommodate a small amount of horizontal movement of the front wheel mount for any situation where the rear axle is fixed. The curved base of the climbing trainer, therefore allows the device to rock or tilt in response to horizontal displacement of the front wheel mount as the elevation of the front end of the bicycle changes.

The climbing trainer may be controlled in various ways. In certain implementations, for example, a wired or wireless controller is provided that allows a user to change the position of the shuttle. The controller may be a dedicated device for the climbing trainer or, in certain implementations, may be an application or similar software executed by a computing device, such as a laptop or mobile phone, that enables the user to change the position of the shuttle. In still other implementations, the climbing trainer may be adapted to interact with a computing device executing ride mapping or similar software from which a user may select a simulated cycling route or exercise routine. The climbing trainer may then receive gradient values, elevation values, control inputs, or similar inputs from the software to automatically and dynamically control the position of the shuttle and, as a result, the inclination of the bicycle attached to the shuttle.

Figure 1B:
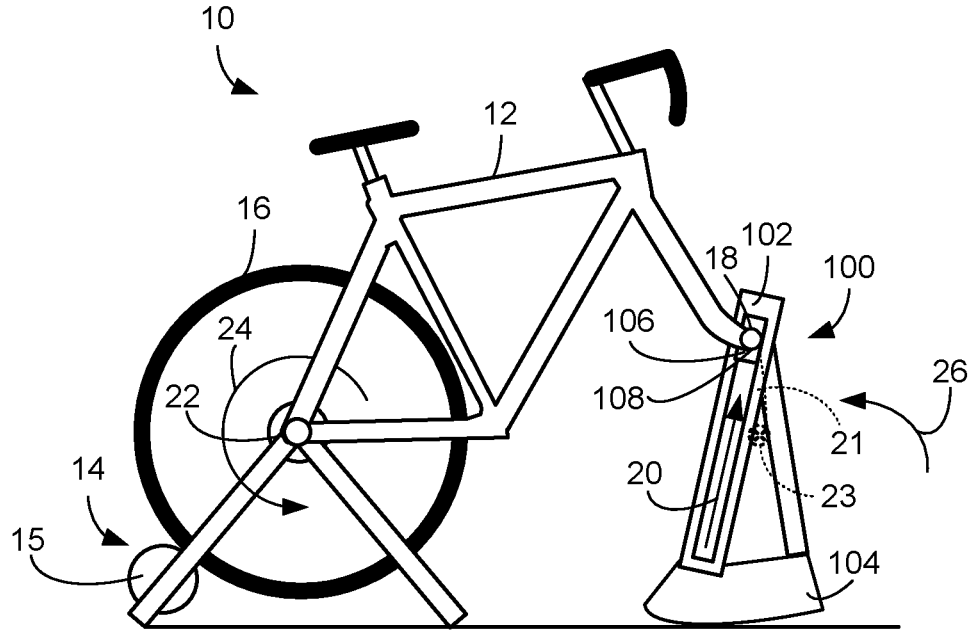

FIGS. 1A and 1B are schematic illustrations of a bicycle training system 10 intended to illustrate operation of a climbing trainer 100 in accordance with this disclosure. In addition to the climbing trainer 100, the bicycle training system 10 includes a bicycle 12 and a bicycle trainer 14. Prior to use, a rider couples the bicycle 12 to each of the bicycle trainer 14 and the climbing trainer 100. As shown in FIGS. 1A and 1B, the bicycle trainer 14 may be a conventional wheel-on bicycle trainer in which a rear wheel 16 of the bicycle 12 engages a roller 15 of the bicycle trainer 14. In such conventional wheel-on bicycle trainers, the bicycle trainer 14 may include a clamp or similar retention feature adapted to retain the rear wheel 16 while still permitting rotation of the rear wheel 16. In other applications, mounting of the bicycle 12 to the bicycle trainer 14 may require removal of the rear wheel 16 and direct mounting of a rear drop out of the bicycle 12 to an axle or mount of the bicycle trainer 14. In still other applications, the bicycle trainer 14 may instead be replaced with cycling rollers on which the rear wheel 16 may rest.

The bicycle 12 is further coupled to the climbing trainer 100. The climbing trainer 100 includes a housing 102 and a curved base 104. Disposed within the housing 102 is a shuttle 106 that linearly translates within the housing 102. In certain implementations, the shuttle 106 includes an axle assembly 108 to which front drop outs 18 of the bicycle 12 may be coupled after removal of a front wheel of the bicycle 12. In other implementations, the shuttle 106 may be adapted to couple with other front wheel mount configurations including, without limitation, a through axle or through-axle supports.

During operation, the shuttle 106 linearly translates within the housing 102, thereby causing changes to the elevation of a front end of the bicycle 12 and the overall inclination of the bicycle 12. For example, FIG. 1A illustrates use of the bicycle training system 10 with the bicycle 12 in a substantially level orientation. In contrast, FIG. 1B illustrates the bicycle training system 10 with the bicycle 12 in an inclined orientation. To transition between the orientation illustrated in FIG. 1A and that in FIG. 1B, the shuttle 106 is linearly translated within the housing 102 (as indicated in FIG. 1B by a first arrow 20). As the shuttle translates, the front end of the bicycle 12 is pushed in a primarily upward direction, causing the bicycle 12 to rotate about a rear axle 22 of the bicycle 12 (as indicated in FIG. 1B by a second arrow 24). In applications in which rear drop outs of the bicycle 12 are directly mounted to the bicycle trainer 14, rotation of the bicycle 12 generally occurs about an axle of the bicycle trainer 14 to which the rear drop outs are coupled.

The climbing trainer 100 also rocks or tilts on its curved base 104 in response to rotation of the bicycle 12 about the rear axle 22 (as indicated in FIG. 1B by a third arrow, 26). Rocking of the climbing trainer 100 is necessary to account for horizontal displacement of the front drop outs 18 during movement of the front end of the bicycle 12. More specifically, because the distance between the rear wheel 16 and the front dropouts 18 is fixed, rotation of the bicycle 12 about the rear wheel 16, as results from movement of the shuttle 106, causes the front dropouts 18 to follow an arcuate path 21 (shown in FIG. 1B originating from a starting point 23 corresponding to the initial location of the front drop outs 18 shown in FIG. 1A) with both vertical and horizontal components. By including the curved base 104, the climbing trainer 100 can rock to accommodate the partially horizontal movement of the front drop outs 18. Doing so reduces stress placed on the climbing trainer 100 and facilitates movement of the shuttle 106 within the housing 102. To improve stability, the curved base 104 may be shaped, in certain implementations, to reflect the path travelled by the shuttle 106 when transitioning between the lowest and highest shuttle positions.

Figure 2:
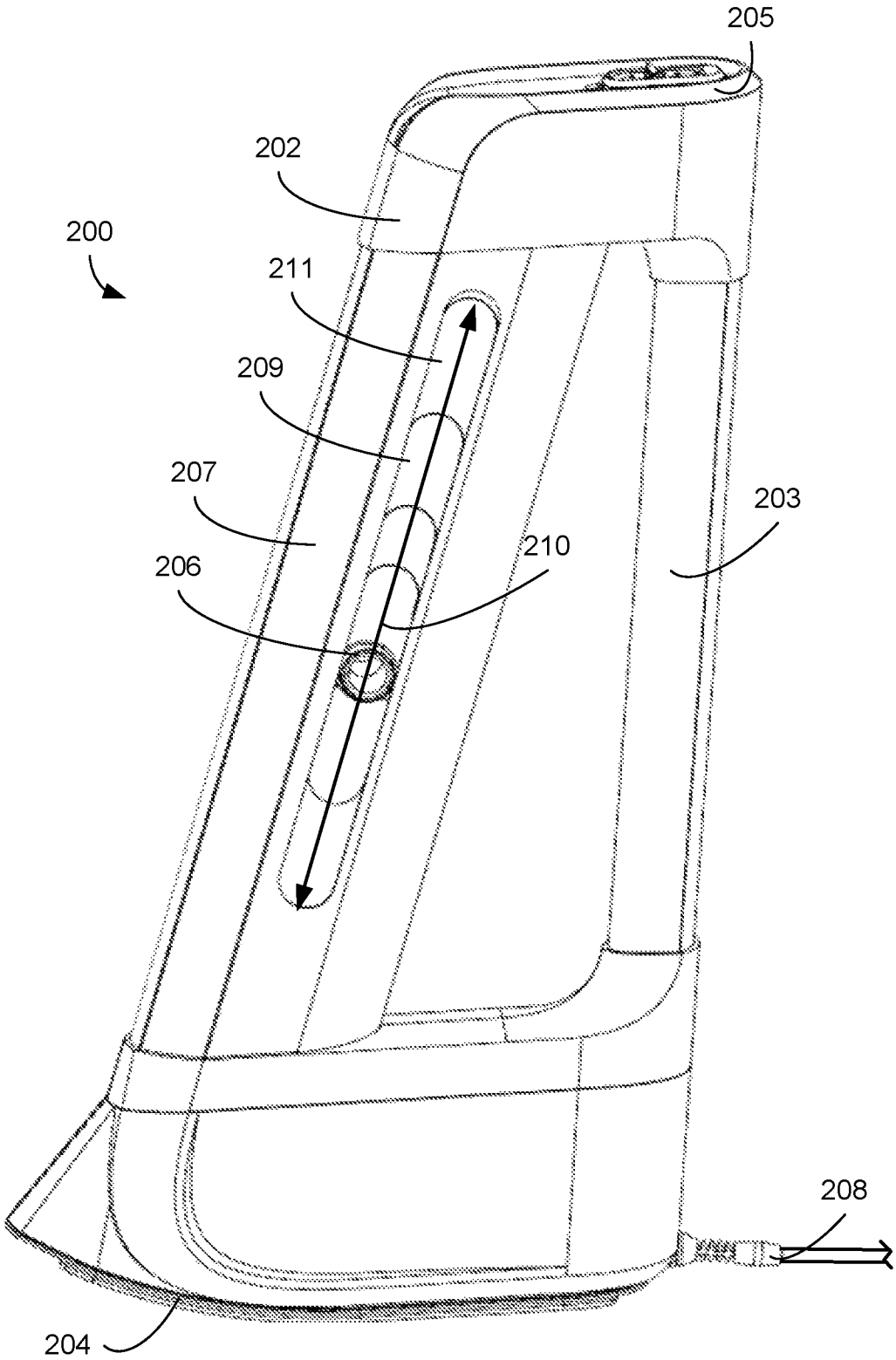
FIG. 2 is a schematic illustration of a second climbing trainer according to the present disclosure.

FIG. 2 is a schematic illustration of a climbing trainer 200 in accordance with the present disclosure. The climbing trainer 200 includes a housing 202 and a curved base 204. Disposed within the housing 202 is a shuttle 206. In certain implementations, the shuttle 206 is adapted to receive an axle assembly (not shown) to which front dropouts of a bicycle may be operably coupled or a similar assembly to which other wheel mounts, such as through axles or through-axle supports, may be coupled. The shuttle 206 is movable along an axis 210 defined by the housing 202. As shown, the housing 202 defines a first elongate opening 211 and a second elongate opening (not shown, but opposite the first elongate opening 211) through which an axle member or similar coupling members of the shuttle 206 extend so that a front fork of a bicycle may be coupled to the shuttle 206. The climbing trainer 200 further includes a power cable 208 that may be used to connect the climbing trainer 200 to a wall socket or similar power source. In certain implementations, the housing 202 may include a shuttle guide member 207 including the shuttle 206 and a support member 203 extending between a top 205 of the climbing trainer 200 and the curved base 204. The support member 203 may provide additional structural support, function as a handle to carry the climbing trainer, and may contain wiring and other electrical components of the climbing trainer 200. The shuttle guide member 207 may include slats, such as a first set of slats 209 corresponding to the first opening 211, that move with the shuttle 206 to close off the elongated openings and therefore prevent ingress into the shuttle guide member 207 through the elongated openings.

Figure 3:
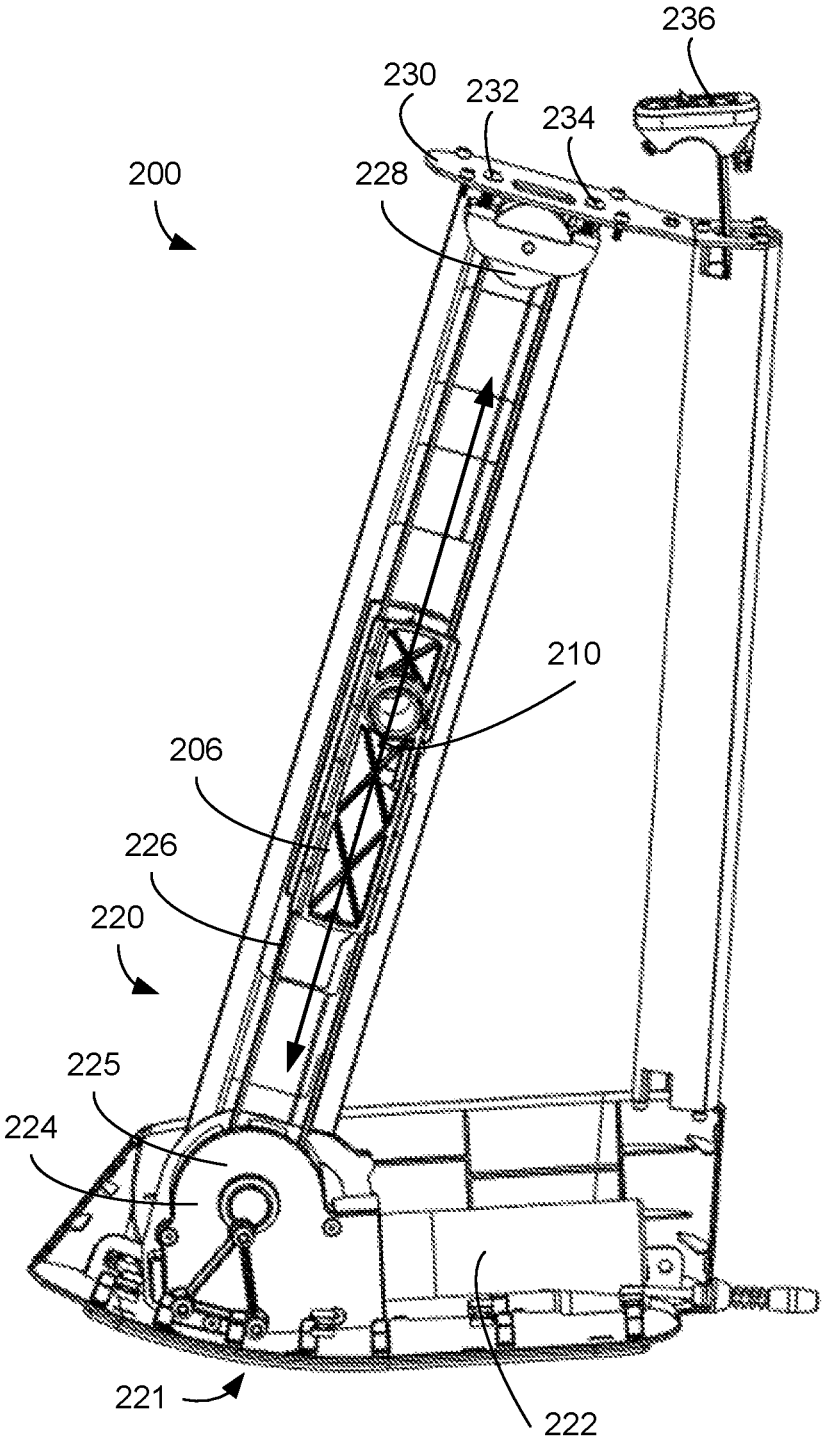
FIG. 3 is a schematic illustration of the climbing trainer of FIG. 2 with an external housing of the climbing trainer partially removed.
Figure 4:
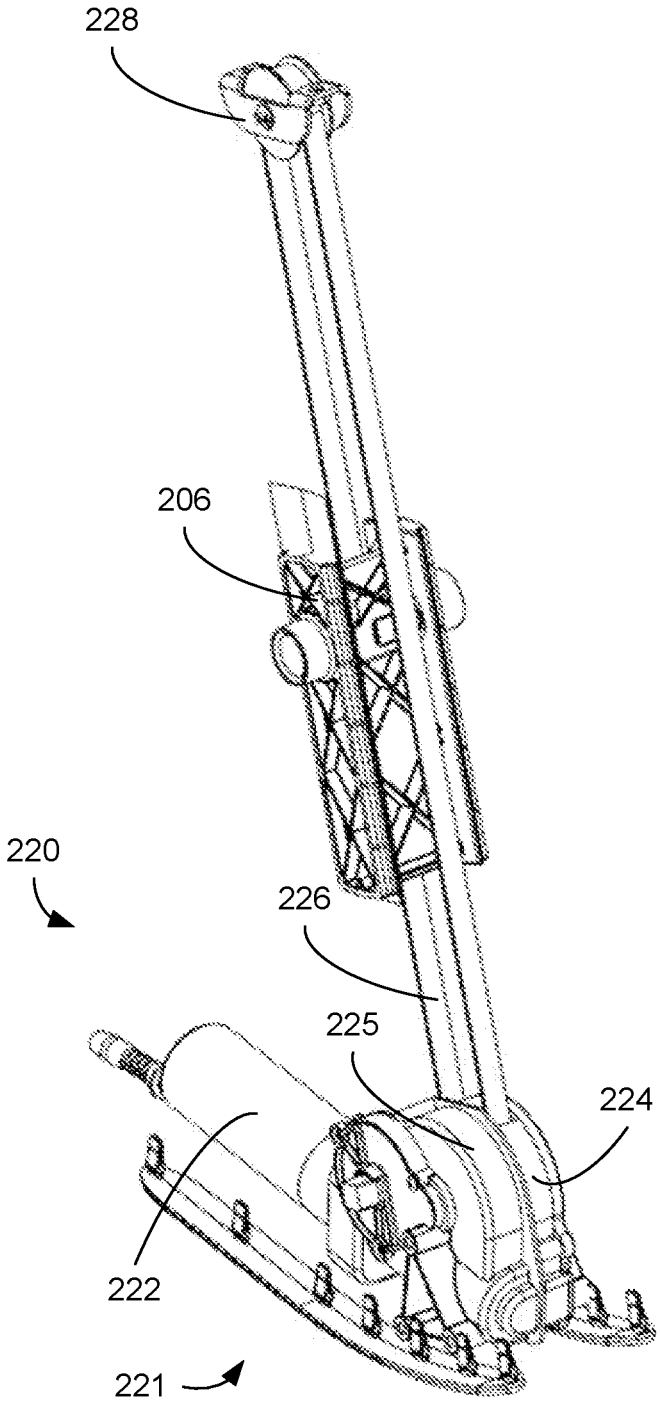
FIG. 4 is a schematic illustration of a drive assembly of the climbing trainer of FIG. 2.

FIGS. 3 and 4 are schematic illustration of the climbing trainer 200 of FIG. 2 with the housing 202 substantially removed to show components within the housing 202. As shown in FIGS. 3 and 4, the climbing trainer 200 includes a drive assembly 220 adapted to move the shuttle 206 within the housing 202 along the axis 210. Although various drive configurations may be implemented, the example implementation of the climbing trainer 200 is a belt drive assembly including a motor assembly 221 that includes a motor 222 and a gear assembly 224 (enclosed within a gear assembly housing 225), a belt 226, and a tensioner pulley 228. During operation, the motor 222 is actuated to cause rotation of gears of the gear assembly 224 which are in turn coupled to the belt 226. The belt 226 is routed around the tensioner pulley 228 and coupled to the shuttle 206. In certain implementations, the belt 226 includes two separate ends and each end is coupled to a side of the shuttle 206, thereby forming a loop. Alternatively, the belt 226 may be continuous and the shuttle 206 may be clipped onto or otherwise coupled to the loop. Regardless of the mounting of the shuttle 206 to the belt 226, actuation of the motor 222 causes rotation of the gears of the gear assembly 224 and movement of the belt 226, thereby causing the shuttle 206 to move upward or downward along the axis 210. By rotating the motor 222 in different directions, the shuttle 206 can be made to move in opposite directions along the axis 210.

The housing 202 may include rails, grooves, or similar features extending through an interior volume of the housing 202 shaped to receive corresponding features of the shuttle 206. Such features may support and guide the shuttle 206 within the housing 202 along the axis 210. The housing 202 may also include hard stops for preventing translation of the shuttle 206 beyond predetermined locations within the housing 202.

As shown in FIG. 3, the tensioner pulley 228 may be mounted to a top plate 230 disposed within the housing 202 using a pair of adjustment screws 232, 234. Accordingly, tension of the belt 226 may be adjusted by loosening or tightening the adjustment screws 232, 234.

In certain implementations, the climbing trainer 200 may include a controller 236 with which a rider may provide instructions to adjust the position of the shuttle 206 and, as a result, the inclination of a bicycle mounted thereto. In certain implementations, the controller 236 may be retractably mounted to the housing 202 such that a user may pull the controller 236 from the housing 202 and mount the controller 236 to handlebars or other fixtures of the bicycle during use of the climbing trainer 200. The controller 236 is just one example of how a rider may control the climbing trainer 200. Additional aspects and approaches to control and operation of the climbing trainer 200 are discussed below in more detail in the context of FIG. 8.

Figure 5:
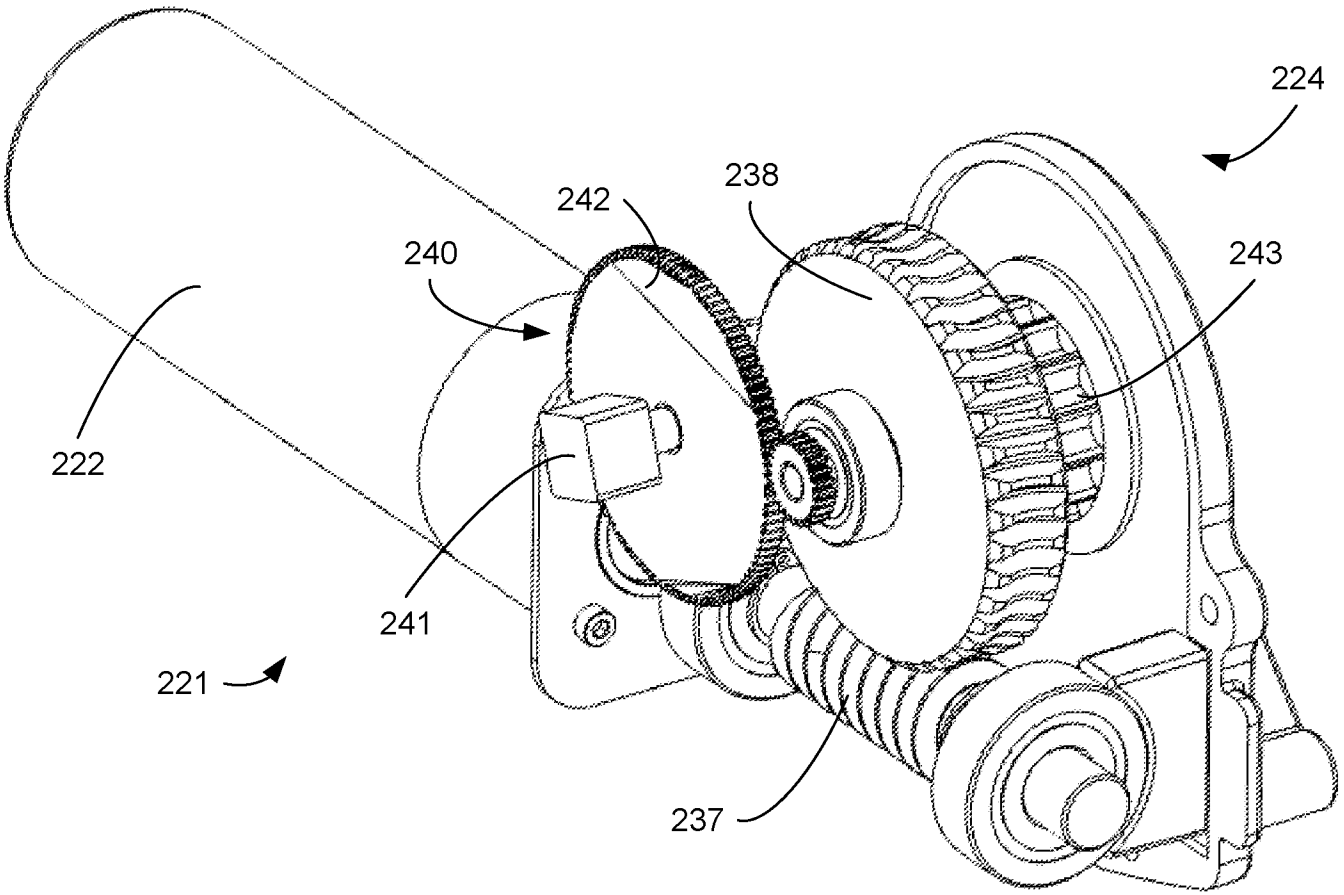
FIG. 5 is a schematic illustration of a motor assembly of the climbing trainer of FIG. 2.

FIG. 5 is a schematic illustration of the motor assembly 221 shown in FIGS. 3 and 4. The motor assembly 221 includes the motor 222 and the gear assembly 224, which is shown with the gear assembly housing 225 (shown in FIGS. 3 and 4) removed. Although various arrangements of gears may be used in embodiments of the present disclosure, the example gear assembly 224 of FIG. 5 includes a worm 237 coupled to the motor 222 such that the worm 237 rotates in response to rotation of the motor 222. The worm 237 is mated with a worm gear 238 to drive the worm gear 238. The worm gear 238 is in turn coupled to a belt pulley 243 that is coupled to the belt 226 (shown in FIGS. 3 and 4) to cause movement of the belt 226 and the shuttle 206 in response to rotation of the motor 222.

In certain implementations, the worm gear 238 may also be coupled to a sensor assembly 240 adapted to provide measurements that may be used to ascertain the position of the shuttle 206. The position of the shuttle 206 may then be used to determine the precise location of a bicycle wheel mount coupled to the shuttle 206 and the inclination of the bicycle itself. For example, the sensor assembly 240 includes a potentiometer 241 coupled to a potentiometer gear 242 that is in turn mated with an intermediate potentiometer gear 244. Accordingly, as the worm gear 238 rotates in response to actuation of the motor 222 and causes movement of the shuttle 206, the resistance of the potentiometer 241 will vary and, as a result, may be used to determine the position of the shuttle 206 within the housing 202.

The potentiometer 241 is merely one way of determining the inclination of the bicycle and other sensors may be used in addition to or instead of the potentiometer 241. For example, in some implementations, the potentiometer 241 may be replace by an encoder, a Hall effect sensor, or other sensor capable of measuring rotation of one or more components of the motor assembly from which a location of the shuttle 206 may be derived. The position of the shuttle 206 may also be measured using, among other things, limit switches disposed within the housing 202 along the axis 210 or accelerometers or similar sensors coupled directly to the shuttle 206. In still other implementations, the inclination of the shuttle 206 may be determined by other sensors, such as accelerometers or inclinometers, adapted to measure the orientation of the climbing trainer or bicycle directly.

Figure 6:
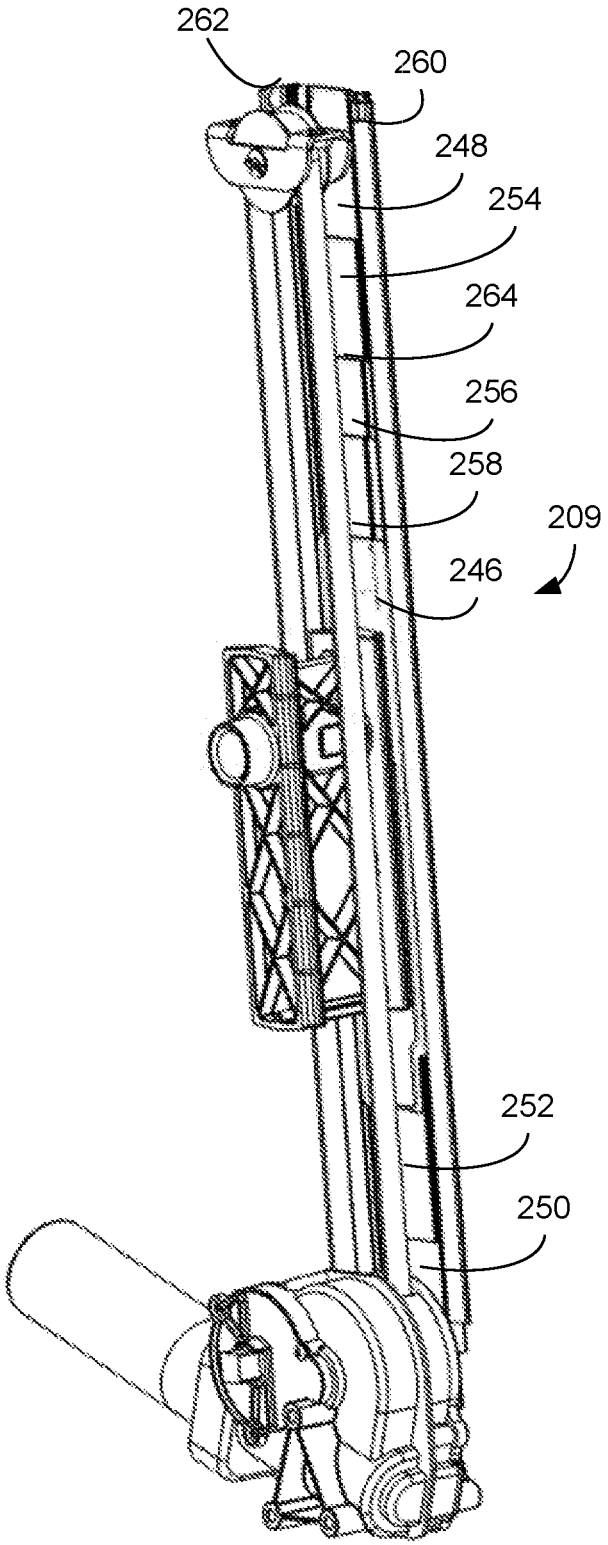
FIG. 6 is a schematic illustration of the internal structure of the climbing trainer of FIG. 2.

FIG. 6 is a partial schematic view of the internal structure of the climbing trainer 200 of FIG. 2 and, more particularly, with the shuttle guide member 207 removed. The shuttle guide member 207 may include slats inserted into the elongated openings of the housing 202 (such as the first elongated opening 211 shown in FIG. 2) to prevent ingress of dirt, debris, hands, and other similar objects into the shuttle guide member 207. In the implementation illustrated in FIG. 6, for example, the shuttle guide member 207 contains a first set of slats 209 disposed along a first side of the shuttle guide member 207 within the first elongated opening 211. A matching second set of slats that functions the same as the first set of slats 209 may also be included on the opposite side of the shuttle guide member 207 to prevent ingress through a second elongated opening opposite the first elongated opening 211, but is omitted in FIG. 6 for clarity. The first set of slats 209 may include a shuttle slat 246 coupled to the shuttle 206. The first set of slats 209 may also include a top fixed slat 248 and a bottom fixed slat 250 and a plurality of layered slats 252-258 disposed between the shuttle slat 246 and the top and bottom fixed slats 248, 250. Each of the slats may be retained within a pair of opposing slat rails 254, 256 such that the shuttle slat 246 and the plurality of layered slats 252 are movable within the slat rails 260, 262. During operation and in response to movement of the shuttle 206, the plurality of slats 252-258 translate and "stack" on each other such that they prevent ingress into the shuttle guide member 207 through the elongated openings regardless of the position of the shuttle 206. For example, in certain implementations, each of the plurality of slats 252-258 may include a lip, such as a lip 264, shaped to contact and engage a translating adjacent slat when the slat and the adjacent slat are substantially overlapping. Accordingly, further translation of the shuttle 206 would cause both the slat and the adjacent slat to translate. In certain implementations, the slats 209 may be replaced with other similar structures including, without limitation, flexible covers such as bellows- or accordion-type panels that fold as the shuttle 206 translates. The slats 209 or similar structures may also be omitted, leaving the elongated openings open. Regardless of whether slats 209 or similar features are included, other features, such as wipers or brushes, may also be included on the shuttle 206 or within the interior of the shuttle guide member 207 to maintain cleanliness within the shuttle guide member 207.

Although the shuttle 206 of the climbing trainer 200 is illustrated as being disposed and movable within the shuttle guide member 207, other arrangements are within the scope of implementations of this disclosure. Generally, the shuttle guide member supports and guides the shuttle within the shuttle guide member and defines an axis parallel or otherwise along which the shuttle moves. In other implementations, however, the shuttle and shuttle guide member may be structured and arranged in various alternative ways other than the shuttle being disposed within the shuttle guide member. In each alternative arrangement, however, the shuttle moves parallel to or otherwise along the path or axis defined by the shuttle guide member.

In a first alternative arrangement, the shuttle is disposed around the shuttle guide member. In such implementations, the shuttle may be in the form of a movable sleeve that defines a through-hole or similar channel through which the shuttle guide member extends. The internal surface of the shuttle and the external surface of the shuttle guide member may be complimentary. For example, the shuttle guide member may have a rail, gear rack, or similar surface shaped to mate with or receive a corresponding groove, gear, or other complimentary structure of the shuttle. During operation, the shuttle translates along the shuttle guide member, maintaining the shuttle guide member within the through-hole or channel. To facilitate translation of the shuttle, the shuttle may be coupled to a drive by a looped belt, chain, or similar component extending around the shuttle guide member. Accordingly, as the drive is actuated, the belt and, as a result, the shuttle may move relative to the shuttle guide member. In another implementation, the drive may instead be incorporated into the shuttle itself. For example, the shuttle may include a rotatable wheel or gear that mates with a corresponding structure of the shuttle guide member such that as the wheel/gear is rotated, the shuttle translates along the shuttle guide member.

In another example alternative arrangement, the shuttle may be disposed adjacent the shuttle guide member such that a side face of the shuttle is in contact with the shuttle guide member. For example, a side face of the shuttle may include a groove, protrusion, gear, wheel, or similar feature adapted to receive or be received by a complimentary structure of the shuttle guide member. Similar to the previously discussed alternative example, the shuttle may be coupled to a drive via a belt or similar component that extends about the shuttle guide member such that actuation of the drive causes movement of the belt and the shuttle relative to the shuttle guide member. As previously noted, the drive may alternatively be incorporated into the shuttle itself.

Figure 7:
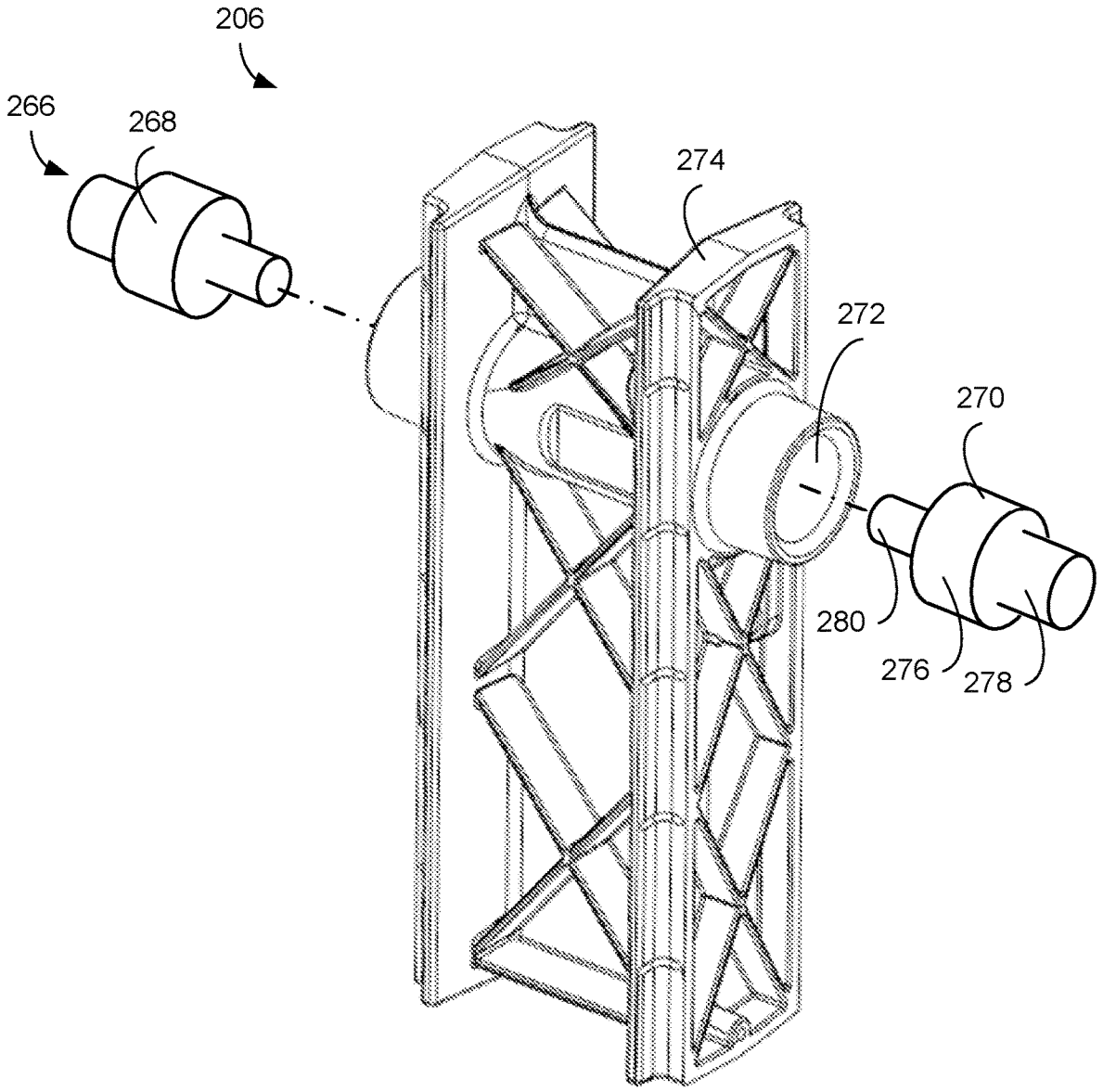
FIG. 7 is a schematic illustration of a shuttle assembly of the climbing trainer of FIG. 2.

FIG. 7 is a schematic illustration of the shuttle 206 shown in FIGS. 2-4, and 6. As previously discussed, the shuttle 206 couples to the belt 226 (shown in FIGS. 3, 4, and 6) such that movement of the belt 226 causes translation of the shuttle 206 within the housing 202 (shown in FIG. 2). The shuttle 206 is also configured to be coupled to front wheel mounts, such as front drop outs or through-axle supports, of a bicycle by an axle assembly 266. The axle assembly 266 shown in FIG. 7, for example, includes a pair of reversible axle inserts 268, 270 that may be inserted into a shuttle bore 272 defined by a body 274 of the shuttle 206. Each of the axle inserts 268, 270 includes an insert body and a pair of axles extending therefrom. Referring to the axle insert 270, for example, the axle insert 270 includes an insert body 276, a first axle extension 278, and a second axle extension 280. The insert body 276 is adapted to mate with and be retained within the shuttle bore 272. Such retention may be achieved by, among other things, a press fit between the insert body 276 and the shuttle bore 268, mating threads of the insert body 276 and the shuttle bore 272, mating twist-lock features of the insert body 276 and the shuttle bore 272, or any other suitable method of retaining the insert body 276 within the shuttle bore 272. The first axle extension 278 and the second axle extension 280 preferably accommodate two different front wheel mounts. For example, in certain implementations, the first axle extension 278 and the second axle extension 280 may be sized to accept wheel mounts having two different drop-out sizes or spacings. In other implementations, the first axle extension 278 may be shaped to receive through-axle supports while the second axle extension 280 may be shaped to receive drop outs. Accordingly, a rider may insert the axle inserts 268, 270 in a first orientation to accommodate a first bicycle having a first front wheel mount configuration and subsequently remove, flip, and reinsert the axle inserts 268, 270 to accommodate a second bicycle having a second front wheel mount configuration.

Reversible axle inserts are simply one way of coupling a bicycle to the shuttle 206. In other implementations, the axle assembly may be similar to a conventional bicycle axle such that the axle assembly is installed by inserting an axle through the shuttle bore 272 and attaching an axle cap to each end of the axle. Such axles may be of varying sizes to accommodate different front drop out configurations and may also incorporate additional features, such as quick release mechanisms, to facilitate coupling and removal of a bicycle from the shuttle 206. In still other implementations, the axle assembly may be integrated with the shuttle 206 such that the shuttle 206 and the axle assembly form a unitary component. In such implementations, bicycle having different front wheel mount dimensions or configurations may be accommodated by exchanging the shuttle 206 for a different shuttle having the required axle assembly.

The belt drive illustrated in FIGS. 3-6 is simply one example of a drive that may be used in climbing trainers in accordance with the present disclosure. More broadly, any suitable drive mechanism adapted to translate the shuttle 206 within the housing 202 may be used in conjunction with or instead of the belt drive of FIGS. 3-6. For example, in certain implementations, the belt 226 may be replaced by a chain or similar flexible linkage with appropriate modifications to the drive assembly 220. In other implementations, the belt drive may be substituted by a linear actuator such as a ball screw drive. The drive mechanism is not limited to purely electromechanical systems and, as a result, linear actuators such as pneumatic or hydraulic cylinders, may also be used in implementations of the present disclosure. In still other implementations, the drive mechanism may be incorporated, at least in part, within the shuttle 206. For example, the shuttle 206 may include a motor and gears such that when the motor is actuated, the gears engage and move along toothed rails disposed along the housing 202, thereby translating the shuttle 206 within the housing 202.

Figure 8:
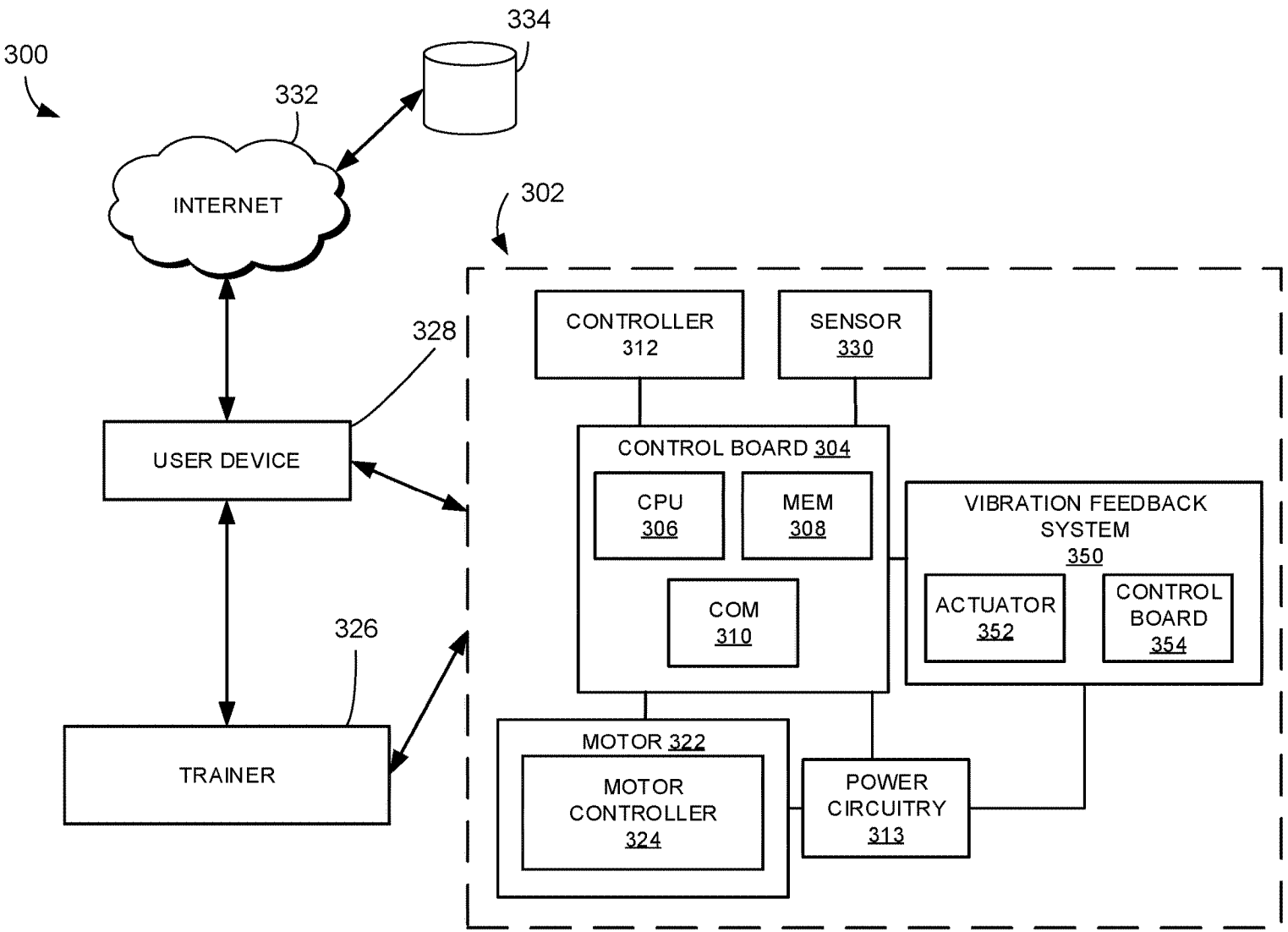
FIG. 8 is a diagram of a training system including a climbing trainer according to the present disclosure.

FIG. 8 is a schematic illustration of a bicycle training system 300 including a climbing trainer 302 in accordance with the present disclosure. The climbing trainer 302 may include various electronic and control components including a control board 304 including one or more processors 306, one or more memories 308, and one or more communication modules 310. The control board 304 may be communicatively coupled to a motor 322 and, more specifically, a motor controller 324 adapted to receive control signals and to drive the motor 322. The climbing trainer 302 may further include power circuitry 313 adapted to receive power from an external source, such as a wall socket, and to perform any necessary transformation to the received power to accommodate the requirements of the climbing trainer 302.

During operation, the processor 306 retrieves and executes commands stored in the memory 308 that cause the processor 306 to issue commands to the motor controller 324. Such commands generally cause actuation of the motor 322 to cause translation of the shuttle (e.g., the shuttle 206 of FIGS. 2-7) within the housing of the climbing trainer 302. The processor 306 may also execute instructions to store data within the memory 308. Such data may include performance and diagnostic data obtained from other components of the climbing trainer 302 or broader bicycle training system 300.

As further illustrated in FIG. 8, the climbing trainer 302 may further include a controller 312 communicatively coupled to the control board 304. The controller 312 may include one or more buttons or switches (which may include "soft" buttons or switches displayed on a touchscreen) that enable a used of the climbing trainer 302 to modify the inclination of a bicycle coupled to the climbing trainer 302 and to otherwise operate the climbing trainer 302. In response to such inputs, the processor 306 issues instructions to components of the climbing trainer 302, such as the motor controller 324. Controls provided to the user through the controller 312 may allow a user to perform various actions including, without limitation, one or more of raising the front end of the bicycle (e.g., by moving the shuttle of the climbing trainer 302 upward), lowering the front end of the bicycle (e.g., by moving the shuttle of the climbing trainer 302 downward), inputting a specific inclination or grade, turning the climbing trainer 302 on or off, resetting the climbing trainer 302 to a level position (i.e., no inclination), switching between a manual operation mode and an automatic operation mode, locking or unlocking the position of the climbing trainer 302, and initiating pairing of the climbing trainer 302 with one or more other devices.

The controller 324 may also include additional components and features. For example, in certain implementations, the controller 324 may include a display for presenting data to a user. Such data may include, among other things, current settings for the climbing trainer 302 and additional performance or settings data, such as performance or settings data obtained from a trainer 326 or a user computing device 328. In certain implementations, the controller 324 may be directly wired to the control board 304. Alternatively the controller 324 may be adapted to wirelessly communicate with the control board 304, such as through the communications module 310, using one or more wireless protocols, such as, without limitation, ANT, ANT+, Bluetooth®, and Wi-Fi.

The climbing trainer 302 may further include at least one sensor 330 from which data may be collected to facilitate determining the current inclination of a bicycle coupled to the climbing trainer 302. The current inclination may then be displayed to the user, such as through the controller 324, or may be used as a feedback value for controlling the climbing trainer 302. The inclination of a bicycle coupled to the climbing trainer 302 may be determined using a wide range of sensors adapted to measure different operating parameters of the climbing trainer 302. For example, the inclination of a bicycle coupled to the climbing trainer 302 may be determined based on, among other things, the position of the shuttle within the housing of the climbing trainer or the inclination of the climbing trainer. Such parameters may be determined in a wide range of ways using different types of sensors.

Determining the position of the shuttle within the housing of the climbing trainer 302, for example, may include determining the extent to which a drive assembly coupled to the shuttle has been actuated. For example, in the implementation illustrated in FIG. 5, the motor assembly 221 includes a potentiometer 241 that indicates the amount of rotation of gears within the motor assembly 221 and, as a result, may be used to derive the position of the shuttle 206. In similar implementations, the sensor 330 may instead be a suitable type of optical (e.g., an encoder) or magnetic (e.g., a Hall effect sensor) adapted to measure rotation of the motor 322 or one or more gears coupled to the motor 322. As an alternative to measuring the actuation of the motor 322, the position of the shuttle within the climbing trainer 302 may be measured directly. For example, the sensor 330 may be one of a plurality of mechanical, optical, or magnetic limit switches disposed within the housing of the climbing trainer 302 corresponding to different shuttle positions within the housing. As the shuttle translates to the shuttle positions, it activates the limit switches, thereby identifying its location within the housing. As yet another example, the sensor 330 may be an accelerometer or similar sensor directly coupled to the shuttle.

Instead of or in addition to measuring the position of the shuttle within the climbing trainer 302, the sensor 330 may measure the position or orientation of the climbing trainer 302. As previously discussed, using the climbing trainer 302 to change the inclination of a bicycle coupled to the climbing trainer 302 causes the climbing trainer 302 to rock or tilt. The inclination of the climbing trainer 302 may then be used to derive the inclination of a bicycle coupled to the climbing trainer 302. Accordingly, the sensor 330 may include, without limitation, an accelerometer, an inclinometer, or any similar sensor for measuring the relative position or orientation of the climbing trainer 302.

As previously noted with respect to communications between the controller 324 and the control board 304, the control board 304 may include a communications module 310. The communications module 310 may facilitate communication between the climbing trainer 302 and other devices through wired, wireless, or a combination of wired and wireless communication protocols. Accordingly, the communications module 310 may include both hardware and software components adapted to transmit and receive data and to convert received data into a format usable by the processor 306 or other components of the control board 304. The communications module 310 may enable communication using wireless communication protocols including, but not limited to ANT, ANT+, Bluetooth®, and Wi-Fi.

As further illustrated in FIG. 8, the climbing trainer 302 may be communicatively coupled to one or both of a trainer 326 and a user computing device 328 and, as a result, may be able to exchange data with the trainer 326 and the user computing device 328. For example, the trainer 326 may be a "smart" bicycle trainer including wireless or other communication capabilities that enable the trainer 326 to, among other things, receive and transmit control signals and performance data. The trainer 326 may further include mechanisms that permit dynamic adjustment of the resistance provided by the trainer 326. The user computing device 328 may be any suitable computing device capable of executing software applications for communicating with the trainer 326 and/or the climbing trainer 302. For example, the user computing device 328 may be a mobile phone, laptop, or bicycle head unit capable of communicating using a communication protocol common to each of the trainer 326 and the climbing trainer 302 and on which a training application or similar software may be executed. The climbing trainer 302 may communicate directly or indirectly with one or both of the trainer 326 and the user computing device 328. For example, in certain implementations, the user computing device 328 and the climbing trainer 302 may communicate indirectly through the trainer 326.

The user computing device 328 may also be communicatively coupled to a network 332, such as the Internet, through which the user computing device 328 may access a data source 334. In certain implementations, the user computing device 328 may access the data source 334 in to retrieve training programs, route data, or similar information from which resistance values and/or inclination values may be obtained or derived. The user computing device 328 may then transmit control signals to the trainer 326 and/or the climbing trainer 302 accordingly. So, for example, the user computing device 328 may retrieve elevation data for a particular real-world route, determine resistance and inclination values for points along the route, generate corresponding control signals, and transmit the control signals to the trainer 326 and the climbing trainer 302 to simulate riding the route.

In certain implementations, the user computing device 328 may also transmit data to the data source 334. For example, a rider may transmit times, statistics, and other performance data collected during a training session for storage in the data source 334 and later retrieval and analysis. The rider may also create training sessions and store the parameters for such sessions in the data source 334. For example, at the beginning of a training session, the rider may initiate recording of the training session such that the resistance of the trainer 326 and the inclination of the climbing trainer 302 are periodically sampled. The corresponding data may then be stored in the data source 334 and retrieved at a later date by the user or a different user to execute a subsequent training session.

In certain implementations, the user computing device 328 may perform some or all of the previously discussed functionality of the controller 324 and the sensor 330 and, as a result, may be used in place of the controller 324 and the sensor 330. For example, the user computing device 328 may be used to execute an application or similar software that allows a user to provide inputs to the climbing trainer 302 and to display data obtained from the climbing trainer 302. Sensors of the user computing device 328 may also be used in addition to or instead of the sensor 330 of the climbing trainer 302. For example, the user computing device 328 may be coupled to handlebars or other part of a bicycle and an internal accelerometer or similar sensor may be used to determine the inclination of the bicycle. The inclination value may then be transmitted to the climbing trainer 302 for use as a feedback value.

Due to variation in bicycle construction and dimensions, control of the climbing trainer 302 may depend, at least in part, on dimensions or similar frame parameters of the bicycle coupled to the climbing trainer 302. In certain implementations, such information may be provided or selected by the user. For example, an application executed on the user computing device 328 may ask a user for a frame size, model, or similar information corresponding to the bicycle. Such information may be used directly or to retrieve supplemental data from a remote data source including more detailed frame parameters. The climbing trainer 302 may also perform a calibration process. Such a calibration process may include, for example, cycling the climbing trainer 302 between its lowest and highest positions and monitoring the orientation of the climbing trainer 302 throughout. The orientation data may then be used to calculate or approximate one or more frame parameters of the bicycle or otherwise form a baseline for measuring the inclination of the bicycle.

As previously discussed, the climbing trainer 302 may operate in either a manual or automatic mode. While in a manual mode, the climbing trainer 302 is controlled in response to input provided by a user, such as by using the controller 324 or the user device 328. Such input may include, among other things, input to incrementally increase an incline, incrementally decrease an incline, set the incline to a particular value, or level the bicycle.

When operating in the automatic mode, on the other hand, the incline provided by the climbing trainer 302 is automatically adjusted over time. In certain implementations, for example, the user may use the controller 324 or the user device 328 to select a predetermined workout or workout goal such that as the user exercises, the climbing trainer 302 may then automatically adjust the position of the climbing trainer 302 in response to the parameters of the workout. For example, the workout may correspond to one or more predefined workout routines such as, without limitation, a hill climb routine, an interval routine, a fat loss routine, or other similar routines, each of which include inclination settings for the climbing trainer 302 that correspond to the particular type of routine. Within each type of routine, the user may also select one or more additional parameters for the routine including a duration of the routine, a difficulty of the routine, a quantity of intervals, a duration of intervals, or any other similar parameter related to the routine. Once a routine has been selected, the climbing trainer 302 may then execute the routine by automatically adjusting the incline over time in accordance with the parameters of the routine.

In certain implementations, the routines may be based on data corresponding to one or more of a recorded ride, a simulated ride, a workout, or similar exercise routine that is available to a user of the climbing trainer 302. The user of the climbing trainer 302 may, for example, access the data from the data source 334 over the Internet 332 with the user device 328. The user device 328 may then execute or otherwise process the data to control the climbing trainer 302. For example, the data may include settings for the climbing trainer 302 or incline, altitude, or similar information that may be translated into settings for the climbing trainer 302 by the user device 328. The data may also include or be translatable into settings (e.g., resistance settings) for the trainer 326 such that as the climbing trainer 302 raises and lowers, the corresponding resistance provided by the trainer 326 may undergo a similar modification. The data may further include video, audio, images, or other multimedia that may be synchronized with the data and played back by the user device 328 during execution of the routine.

FIG. 8 illustrates the climbing trainer 302 communicatively coupled to each of the user device 328 and the trainer 326. However, other communications architectures may also be implemented. In one implementation, the trainer 326 may act as an intermediary between the user device 328 and the climbing trainer 302 such that signals from the user device 328 are received by the trainer 326 and corresponding control signals for the climbing trainer 302 are then sent from the trainer 326 to the climbing trainer 302. In another implementation, the user device 328 may pair with each of the trainer 326 and the climbing trainer 302 and may send control signals to each without communication passing directly between the trainer 326 and the climbing trainer 302.

The climbing trainer 302 may further include a vibration feedback system 350 configured to provide feedback during use of the climbing trainer 302. The vibration feedback system 350 is generally configured to induce vibrations in a bicycle coupled to the climbing trainer 302. Such vibrations may, for example, be used to simulate different terrain or riding surfaces such as, without limitation, a track, pavement, gravel, or cobblestone.

In certain implementations, such as that illustrated in FIG. 8, the vibration feedback system 350 may be partially implemented using dedicated hardware components communicatively coupled to the control board 304. Such components may include, for example, a motor or other actuator 352 that is fixed to a component of the climbing trainer 302 such that actuation of the actuator induces vibrations in the structural element which are then transmitted to the bicycle coupled to the climbing trainer 302. For example and without limitation, the actuator 352 may be coupled to the shuttle, the housing, the base, or any other element of the climbing trainer 302 that is directly or indirectly coupled to the bicycle.

As illustrated in FIG. 8, in hardware-based implementations of the vibration feedback system, the components of the vibration feedback system 350 may also be coupled to the power circuitry 313 of the climbing trainer 302 to receive power for controlling the actuator. The vibration feedback system 350 may further include a system control board 354 for controlling the actuator 352 in response to control signals received from the control board 304. For example, the control board 304 may provide one or more of a vibration frequency, a vibration amplitude, or a setting (e.g., a desired surface or vibration intensity level) that, when received by the vibration feedback system 350, is translated by the system control board 354 into control signals for controlling the actuator 352.

In other implementations, feedback may be implemented, at least in part, through software control of the motor 322. In such software-based implementations, vibrations may be induced in the bicycle by controlling the motor 322 to rapidly oscillate the shuttle. More specifically, in addition to larger scale back-and-forth movements of the shuttle to change inclination of the bicycle, the motor 322 may also be adapted to make small back-and-forth movements/oscillations of the shuttle that simulate different riding surfaces. Such oscillations may occur independently of the larger scale movements (e.g., to simulate riding on a particular surface at a steady grade) or in conjunction with the larger scale movements (e.g., to simulate riding on a particular surface as grade changes).

In either hardware- or software-based implementations, the vibrations induced by the vibration feedback system may be varied during use of the climbing trainer 302. For example, a user may increase, decrease, turn on, or turn off vibration feedback by providing corresponding input through the user device 328, the controller 324, or other input device. In one implementation, a user may change the feedback settings by choosing between predetermined settings (e.g., a "road" setting, a "gravel" setting) for different riding surfaces, each of the predetermined settings resulting in different combinations of vibration frequencies and amplitudes corresponding to the riding surfaces.

Instead of or in addition to manual changes by the user, settings for the vibration feedback system may be automatically changed in response to an exercise routine, workout, or simulated ride executed by the user device 328. For example, the data received and executed by the user device 328 to control the climbing trainer 302 for a simulated ride may include both incline and riding surface data. Accordingly, as the user device 328 executes the simulated ride, the user device 328, the data may indicate a change in riding surface that is then transmitted by the user device 328 to the control board 304. In response, the control board 304 may transmit corresponding feedback settings (or signals corresponding to the settings) to the hardware components of the vibration feedback system (in hardware-based implementations) or to the motor controller 324 (in software-based implementations) to change the settings of the vibration feedback system to reflect the new riding surface.

Figure 9:
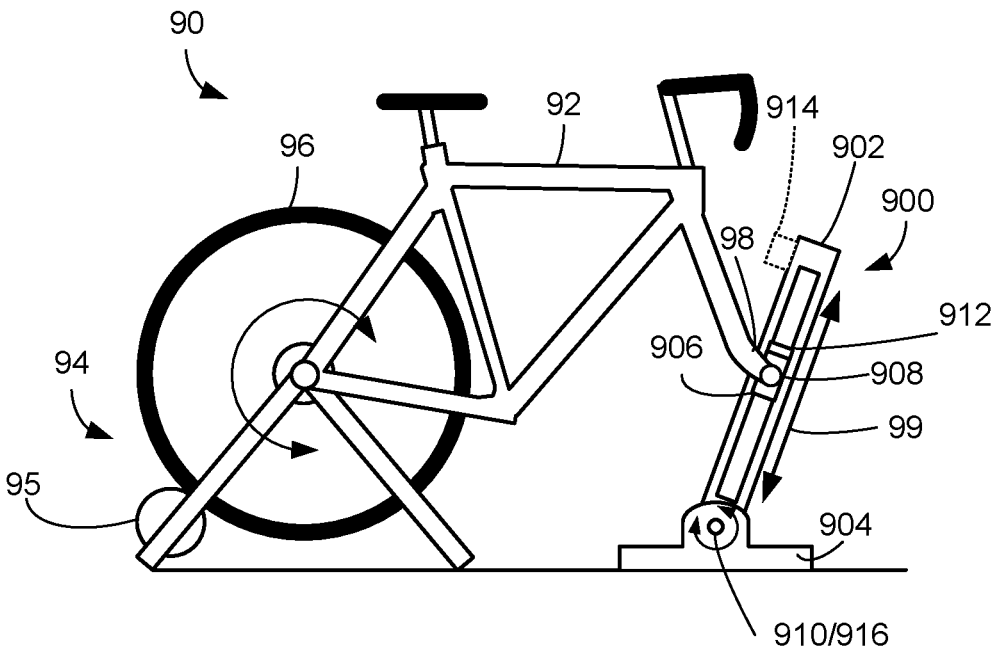
FIG. 9 is a schematic illustration of an alternative implementation of a bicycle training system including a second climbing trainer according to the present disclosure.

FIG. 9 is a schematic illustration of an alternative bicycle training system 90 including a climbing trainer 900 in accordance with this disclosure. In addition to the climbing trainer 900, the bicycle training system 90 includes a bicycle 92 and a bicycle trainer 94. The bicycle 92 is shown coupled to each of the bicycle trainer 94 and the climbing trainer 900. Although other arrangements are possible (as previously discussed herein), as shown in FIG. 9, the bicycle trainer 94 is a conventional wheel-on bicycle trainer in which a rear wheel 96 of the bicycle 92 engages a roller 95 of the bicycle trainer 94.

The climbing trainer 900 includes a housing 902 and a fixed base 904. Disposed within the housing 902 is a shuttle 906 that linearly translates within the housing 902. The shuttle 106 further includes an axle assembly 908 to which front drop outs 98 of the bicycle 92 may be coupled after removal of a front wheel of the bicycle 92. In other implementations, the shuttle 906 may be adapted to couple with other front wheel mount configurations including, without limitation, a through axle or through-axle supports.

During operation of the climbing trainer 900, the shuttle 906 is translated along an axis (as indicated by arrow 99). As the shuttle 906 translates, the bicycle 92 inclines or declines accordingly by rotating about the coupling between the bicycle 92 and the bicycle trainer 94. In contrast to the previously discussed implementations of this disclosure in which the horizontal component of the coupling between the bicycle and climbing trainer was accounted for by the climbing trainer including a curved base, the climbing trainer 900 includes a rotational coupling 910 between the housing 902 and the fixed base 904. Accordingly, as the shuttle 906 is translated to change the inclination of the bicycle 92, the housing 902 is permitted to rotate about the rotational coupling 910, compensating for the horizontal component of the coupling between the axle assembly 908 and the front drop outs 98.

As previously discussed, implementations of climbing trainers according to the present disclosure may also include a feedback mechanism 912 that induces vibrations in a bicycle coupled to the climbing trainer. Such vibrations may be used, for example, to simulate the feel of various riding surfaces by varying the amplitude and/or frequency of the vibrations to approximate vibrations that would be experience by a rider if actually riding a particular surface. For example, relatively minimal vibrations may be induced by the feedback mechanism 912 when simulating a substantially smooth race track while increased vibrations could be applied to simulate other surfaces including, but not limited to, road, gravel, or cobblestone. In certain implementations, the vibrations induced by the feedback mechanism 912 may be provided in response to predetermined settings corresponding to different riding surfaces. Alternatively, the vibrations induced by the feedback mechanism 912 may correspond to vibrometer, accelerometer, or other vibration measurement device data collected during a real-world ride and stored subsequent retrieval and execution during a workout routine.

The feedback mechanism 912 may be a separate component of the climbing trainer or may correspond to a method of operating the drive mechanism for translating the shuttle. In implementations in which the feedback mechanism 912 is a separate component, the feedback mechanism 912 may include a vibration-inducing device, such as an eccentric rotation mass (ERM) motor, linear actuator, or similar device that is coupled to one of the shuttle, the shuttle guide member, the base, or another structural of the climbing trainer. For example, the climbing trainer 900 of FIG. 9 includes an ERM 912 coupled directly to the shuttle 906 to induce vibrations in the shuttle 906 that are then transmitted to the bicycle 92 due to the coupling of the shuttle 906 to the drop outs 98 of the bicycle 92.

In other implementations, the feedback mechanism 912 may be directly coupled to a structural element of the climbing trainer. For example, FIG. 9 further indicates an alternative location 914 for a feedback mechanism in which the feedback mechanism is coupled directly to the shuttle guide member 902. In still other implementations, the feedback mechanism may be coupled to, among other things, the base 904 of the climbing trainer 900 or another structural support member of the climbing trainer (such as the support member 203 of the climbing trainer 200 illustrated in FIG. 2).

In certain implementations feedback may instead be provided by inducing vibrations with the drive mechanism 916 used to translate the shuttle 906. The drive mechanism 916 (which is incorporated into the base 904 in the example climbing trainer 900) is adapted to translate the shuttle 906 along the shuttle guide member 902 to simulate changes in incline. In certain implementations, the drive mechanism 916 may be further adapted to rapidly move the shuttle 906 back and forth along the shuttle guide member 902 to induce vibrations in the front drop out 98 and simulate different riding surfaces. By changing the frequency and amplitude of the shuttle oscillations, vibrations having different qualities may be induced, thereby allowing simulation of different surfaces.

Figure 10:
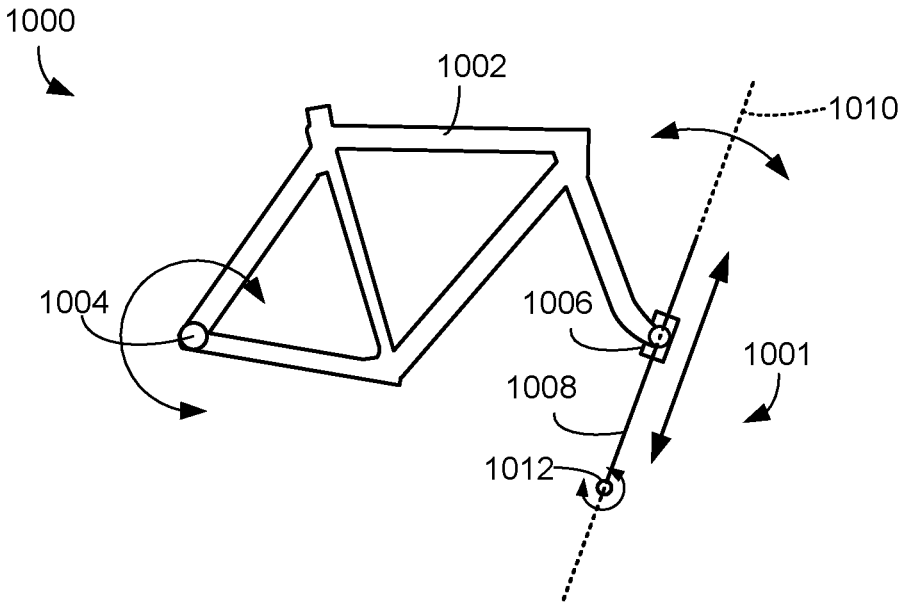
FIG. 10 is a kinematic representation of a bicycle training system according to the present disclosure.

FIG. 10 is a schematic illustration of another bicycle training system 1000 in accordance with the present disclosure. The bicycle training system 1000 is illustrated in the form of a kinematic diagram to emphasize the functional aspects of training systems in accordance with the present disclosure.

The bicycle training system 1000 includes a bicycle, indicated by a frame 1002, which is coupled in two locations. First, a rear portion of the frame 1002 is rotationally coupled to a rear pivot point 1004. As previously discussed, the rear pivot point 1004 may take varying forms. For example, in implementations in a wheel-on type trainer, the rear pivot point 1004 may generally correspond to the rear axle of the bicycle. In a wheel-off type trainer, the rear pivot point 1004 may correspond to an axle assembly of the trainer to which the rear drop outs of the bicycle frame are coupled. Alternatively, if a roller-type trainer is implemented, the pivot point 1004 may correspond to the rear axle of the bicycle.

Second, a front portion of the frame 1002 is coupled to a movable shuttle 1006 of a climbing trainer 1001. The shuttle 1006 is supported by and movable relative to a primary member 1008. As previously noted, the arrangement of the shuttle 1006 and the primary member 1008 may take various forms. For example, the shuttle 1006 may be disposed within the primary member 1008, around the primary member 1008, or adjacent the primary member 1008. The primary member 1008 defines an axis 1010 that defines the path along which the shuttle 1006 translates. More specifically, the axis 1010 defines a path parallel to which the shuttle 1006 moves in response to activation of a drive mechanism (not illustrated) configured to translate the shuttle 1006. In implementations in which the shuttle 1006 is substantially centered on the housing, parallel movement of the shuttle 1006 may correspond to collinear movement of the shuttle 1006 along the axis 1010.

As the shuttle 1006 translates relative to the axis 1010, the primary member 1008 is permitted to rotate about a front pivot point 1012 to compensate for horizontal displacement of the shuttle 1006 as the frame 1002 is rotated about the rear pivot point 1004. As discussed herein, the front pivot point 1012 may correspond to a rotational coupling between the primary member 1008 and a fixed base of the climbing trainer 1001 (such as illustrated in FIG. 9). Alternatively, the front pivot point 1012 may correspond to a contact point between a curved foot of the climbing trainer 1001 and the ground. In such cases, the pivot point may shift or otherwise correspond to different points of the curved foot as the primary member 1008 rotates.

Although various representative embodiments have been described above with a certain degree of particularity, those skilled in the art could make numerous alterations to the disclosed embodiments without departing from the spirit or scope of the inventive subject matter set forth in the specification. All directional references (e.g., upper, lower, upward, downward, left, right, leftward, rightward, top, bottom, above, below, vertical, horizontal, clockwise, and counterclockwise) are only used for identification purposes to aid the reader's understanding of the embodiments of the present invention, and do not create limitations, particularly as to the position, orientation, or use of the invention unless specifically set forth in the claims. Joinder references (e.g., attached, coupled, connected, and the like) are to be construed broadly and may include intermediate members between a connection of elements and relative movement between elements. As such, joinder references do not necessarily infer that two elements are directly connected and in fixed relation to each other.

In methodologies directly or indirectly set forth herein, various steps and operations are described in one possible order of operation, but those skilled in the art will recognize that steps and operations may be rearranged, replaced, or eliminated without necessarily departing from the spirit and scope of the present invention. It is intended that all matter contained in the above description or shown in the accompanying drawings shall be interpreted as illustrative only and not limiting. Changes in detail or structure may be made without departing from the spirit of the invention as defined in the appended claims.

The invention claimed is:

1. A training device for use with a bicycle having a front end, the training device comprising:

a shuttle guide member comprising a lower end and an upper end, wherein the upper end includes a top surface;

a shuttle operably coupleable to the front end of the bicycle and translatable along the shuttle guide member;

a drive coupled to the shuttle to translate the shuttle along the shuttle guide member; and a controller disposed in the top surface, wherein the controller is configured to receive inputs from a user to translate the shuttle, and wherein, when coupled to the front end of the bicycle, translation of the shuttle by the drive results in a change in elevation of the front end of the bicycle.

2. The training device of claim 1, wherein the drive is a screw drive.

3. The training device of claim 1, wherein the controller is detachable from the top surface.

4. The training device of claim 1 further comprising a processor configured to operate the drive, wherein the controller is detachable from the top surface and communicates with the processor over a wireless connection.

5. The training device of claim 1 further comprising a processor configured to operate the drive, wherein the controller is detachable from the top surface and communicates with the processor over a wired connection.

6. The training device of claim 1, further comprising a processor configured to operate the drive, wherein the processor is configured to receive control commands from the controller and at least one of a trainer computing device and a user computing device.

7. The training device of claim 1, wherein the shuttle guide member includes a side face and the shuttle translates along the side face.

8. The training device of claim 1, wherein the shuttle includes a pair of axle inserts for coupling the shuttle to the front end of the bicycle or is adapted to receive a through axle to couple the shuttle to the front end of the bicycle.

9. The training device of claim 1, wherein, when coupled to the front end of the bicycle, translation of the shuttle by the drive further results in horizontal displacement of the shuttle.

10. A training device for use with a bicycle having a front end, the training device comprising:

a shuttle guide member comprising a lower end and an upper end, wherein the upper end includes each of a top surface and a side face;

a shuttle operably coupleable to the front end of the bicycle and translatable along the side face of the shuttle guide member;

a drive coupled to the shuttle to translate the shuttle along the shuttle guide member; and a controller coupled to the top surface, wherein the controller is configured to receive inputs from a user to actuate the drive to translate the shuttle, and wherein, when coupled to the front end of the bicycle, translation of the shuttle by the drive results in a change in elevation of the front end of the bicycle.

11. The training device of claim 10, wherein the drive is a screw drive.

12. The training device of claim 10, further comprising a processor configured to operate the drive, wherein the processor is configured to receive control commands from the controller and at least one of a computing device of a trainer and a user computing device.

13. The training device of claim 10, wherein, when coupled to the front end of the bicycle, translation of the shuttle by the drive further results in horizontal displacement of the shuttle.

14. The training device of claim 10, wherein the shuttle includes a pair of axle inserts for coupling the shuttle to the front end of the bicycle.

15. The training device of claim 10, wherein the shuttle is adapted to receive a through axle to couple the shuttle to the front end of the bicycle.

16. A training device for use with a bicycle having a front end, the training device comprising:

a shuttle guide member comprising a lower end and an upper end, wherein the upper end includes a top surface;

a shuttle operably coupleable to the front end of the bicycle and translatable along the shuttle guide member; and a drive coupled to the shuttle to translate the shuttle along the shuttle guide member;

a controller disposed in the top surface; and a processor communicatively coupled to the controller, wherein the processor is configured to receive inputs from each of the controller and a computing device separate from the training device to actuate the drive to translate the shuttle, and wherein, when coupled to the front end of the bicycle, translation of the shuttle by the drive results in a change in elevation of the front end of the bicycle.

17. The training device of claim 16, wherein the drive is a screw drive.

18. The training device of claim 16, wherein the computing device is of a trainer.

19. The training device of claim 16, wherein the computing device is a first computing device and the processor receives inputs from the first computing device via a second computing device of a trainer.

20. The training device of claim 16, wherein the shuttle guide member includes a side face and the shuttle translates along the side face.

* * * * *